US005188545A

United States Patent [19]

Hass et al.

[11] Patent Number: 5,188,545

[45] Date of Patent: Feb. 23, 1993

[54] ELECTRICAL SOCKET TERMINAL

[75] Inventors: Jurgen Hass, Erzhausen; Gheorghe Hotea, Greisheim; Guenter Siegel, Niederdorffelden, all of Fed. Rep. of Germany

[73] Assignee: AMP Incorporated, Harrisburg, Pa.

[21] Appl. No.: 852,485

[22] Filed: Mar. 16, 1992

Related U.S. Application Data

[63] Continuation of Ser. No. 696,259, Apr. 30, 1991, abandoned, which is a continuation of Ser. No. 533,633, Jun. 5, 1990, abandoned.

[51] Int. Cl.[5] ..... H01R 13/11

[52] U.S. Cl. ..... 439/851; 439/880

[58] Field of Search ..... 439/851, 852, 856, 857, 439/842, 846, 880, 877, 845, 849

[56] References Cited

U.S. PATENT DOCUMENTS

| | | | |
|---|---|---|---|
| 1,451,548 | 12/1891 | Kreisheld | 439/851 |
| 3,158,424 | 11/1964 | Bowen | 439/744 |
| 3,228,207 | 1/1966 | Hartmann, Jr. et al. | 439/849 |
| 3,363,224 | 10/1965 | Gluntz | 339/258 |
| 4,602,839 | 7/1986 | Winger | 439/747 X |
| 4,666,227 | 5/1987 | Galizia et al. | 439/851 X |
| 4,707,050 | 11/1987 | Konnemann | 439/851 |
| 4,722,704 | 2/1988 | Van Der Stuyf et al. | 439/851 |
| 4,798,545 | 1/1989 | Roy et al. | 439/677 |

FOREIGN PATENT DOCUMENTS

| | | | |
|---|---|---|---|
| 0191539 | 2/1986 | European Pat. Off. . | |
| 3540869 | 11/1985 | Fed. Rep. of Germany . | |
| 3424072 | 1/1986 | Fed. Rep. of Germany | 439/857 |
| 8608199 | 3/1986 | Fed. Rep. of Germany . | |
| 1435587 | 5/1973 | United Kingdom . | |
| 1571601 | 7/1976 | United Kingdom . | |

OTHER PUBLICATIONS

Int'l Search Report DTD May, 9, 1989.

*Primary Examiner*—Eugene F. Desmond

*Attorney, Agent, or Firm*—Bruce J. Wolstoncroft

[57] ABSTRACT

The terminal (2) comprises a stamped and formed metal pin socket (6) comprising a base (12) from which extend two contact springs (14) each comprising an L-cross section forward portion having identical parts (18 and 20) which extend at right angles to each other. Back from contact bosses (22) of the springs (14), each spring (14) has a longitudinal slot (28) which enables the parts (18 and 20) of each spring (14) to splay resiliently apart from each other when a square cross section pin (P) is inserted into the socket (6), without the pin insertion force or the contact force exerted by the contact bosses (22) against the pin (P), being excessive. These forces can be predetermined by suitably dimensioning the slots (28).

10 Claims, 4 Drawing Sheets

ELECTRICAL SOCKET TERMINAL

This application is a continuation of application Ser. No. 07/696,259 filed Apr. 30, 1991, now abandoned, in turn, a continuation of application Ser. No. 07/533,633 filed Jun. 5, 1990, now abandoned.

FIELD OF THE INVENTION

This invention relates to an electrical socket terminal for mating with an electrical pin.

BACKGROUND OF THE INVENTION

There is disclosed in the specification of DE-U-8608199.3, an electrical socket terminal comprising an elongate stamped and formed metal socket having a tubular base from one end of which projects a pair of elongate contact springs, which extend in a direction away from said base and have contact surfaces which are proximate to a forward end of the socket, remote from the base, and which extend towards each other to grip an electrical pin inserted between the contact surfaces from said forward end.

SUMMARY OF THE INVENTION

It is an object of the present invention to provide such a socket terminal, in which the contact force exerted by the contact surfaces against the pin can readily and accurately be positioned.

According to the present invention, therefore, an electrical socket terminal as defined in the second paragraph of this specification is characterized in that each contact spring is of substantially L-shaped cross section, and thus has two parts extending transversely of each other as seen in cross section, each part being formed with one of said contact surfaces, the two parts of each contact spring being divided by a slot extending longitudinally of the contact spring, between the contact surfaces thereof and said base. The said contact force is determined by the length of said slots which can accurately be stamped out of a sheet metal blank from which the socket terminal is to be formed.

The two parts of each contact spring preferably extend at right angles to each other and are preferably of identical dimensions, the pin being of square cross section, the contact surfaces being smoothly arcuate.

According to an embodiment of the invention, each slot extends for the whole distance between the contact surface and the base. The base is preferably of square cross section, each contact spring extending from the forward ends of two adjacent side walls of the base. The socket terminal is preferably provided with a protective sleeve which acts to restrain overstress of the contact springs, should the terminal be mated with an oversized pin or a pin be inserted into the socket in misalignment therewith.

BRIEF DESCRIPTION OF THE DRAWINGS

For a better understanding of the invention, and to show how it may be carried into effect, reference will now be made by way of example to the accompanying drawings in which.

DETAILED DESCRIPTION OF THE INVENTION

Figure 1:
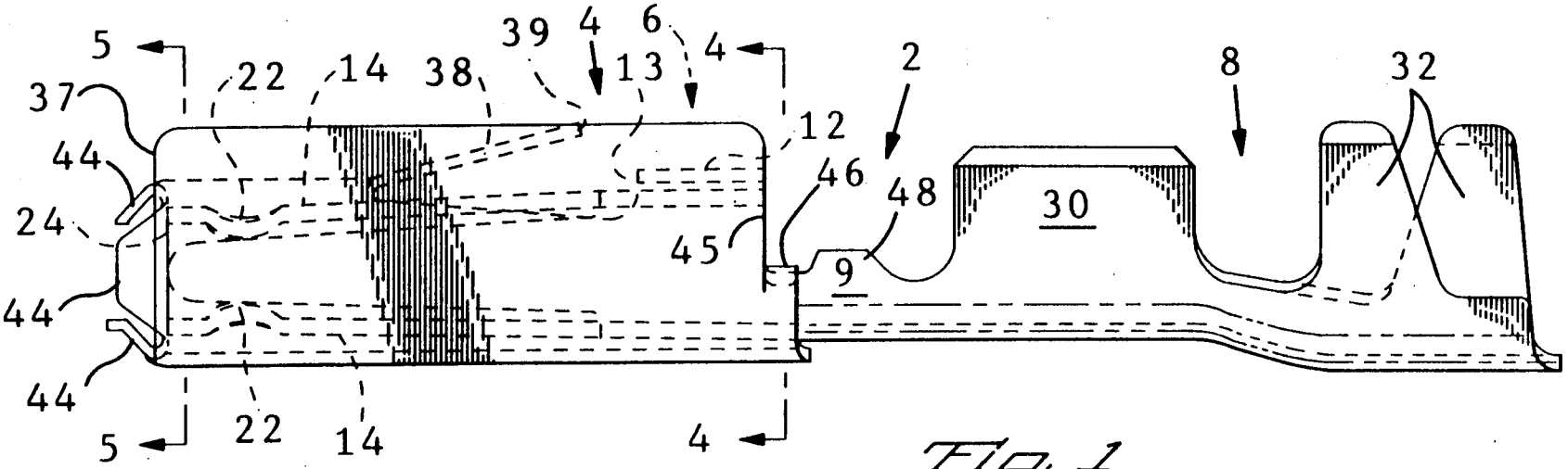
FIG. 1 is a side view of an electrical socket terminal provided with a protective sleeve.
Figures 3, 4, 5, 6, 7, 8:
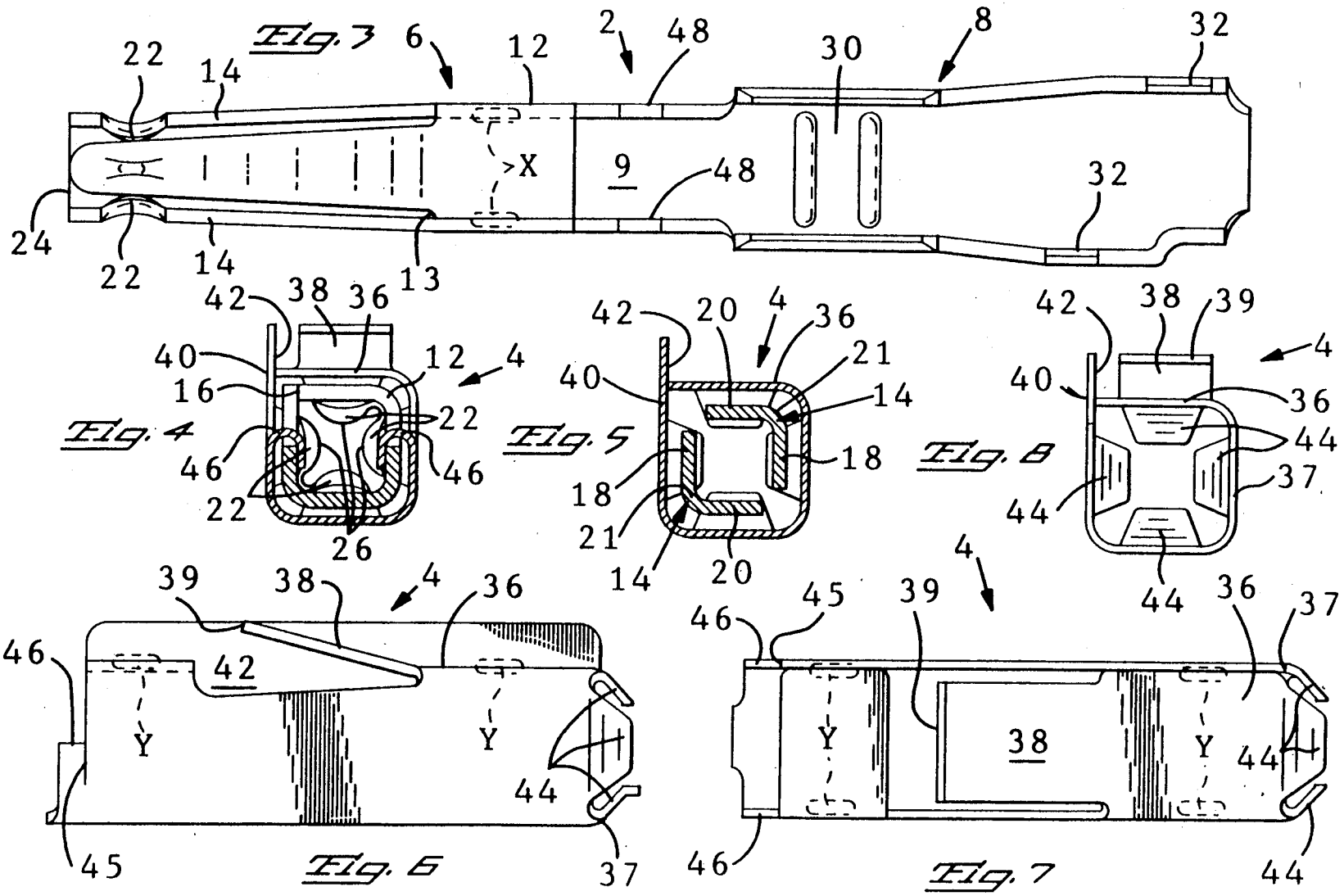
FIG. 3 is a top plan view of the socket terminal.
FIG. 4 is a view taken on the lines 4—4 of FIG. 1.
FIG. 5 is a view taken on the lines 5—5 of FIG. 1.
FIG. 6 is a side view of the protective sleeve.
FIG. 7 is a top plan view of the protective sleeve.
FIG. 8 is a front end view of the protective sleeve.
Figure 9:
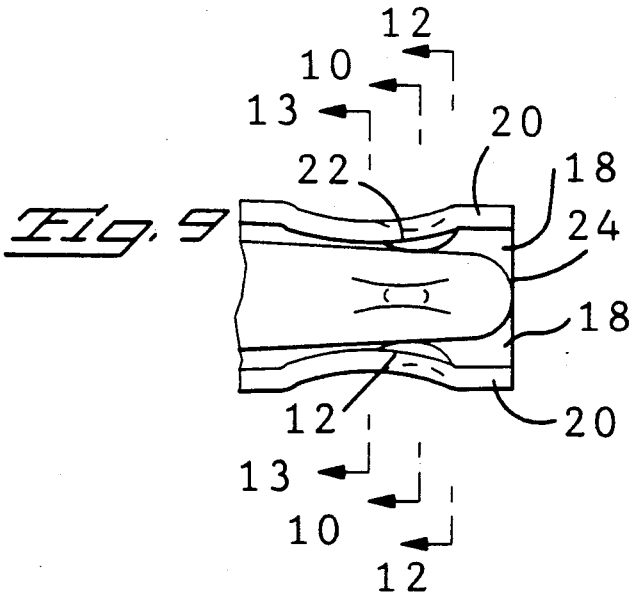
FIG. 9 is a fragmentary side view of the forward end of the socket terminal.
Figure 10:
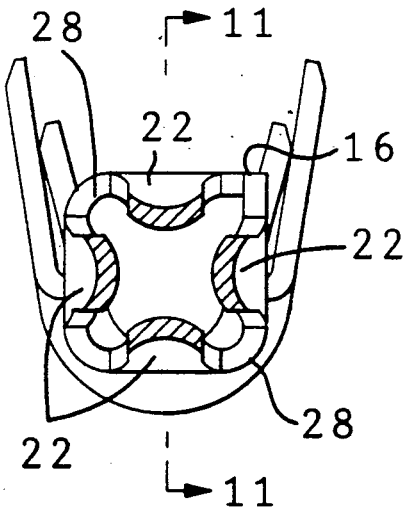
FIG. 10 is a view taken on the lines 10—10 of FIG. 9.
Figure 11:
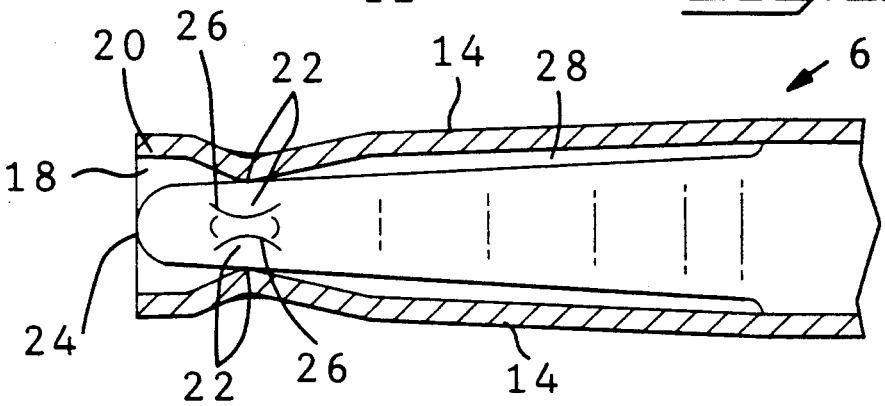
FIG. 11 is a fragmentary view taken on the lines 11—11 of FIG. 10.
Figure 12:
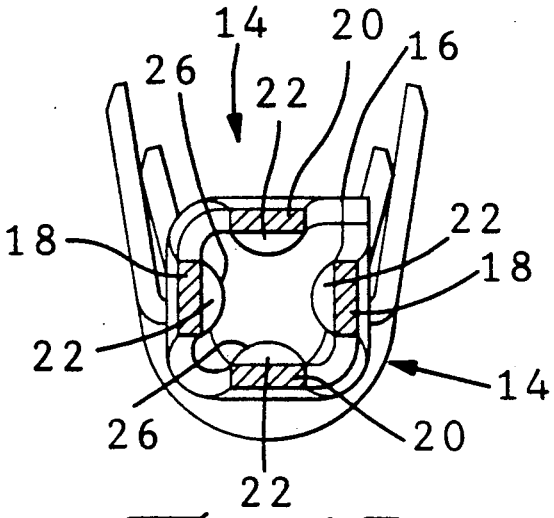
FIG. 12 is a view taken on the lines 12—12 of FIG. 9.
Figure 13:
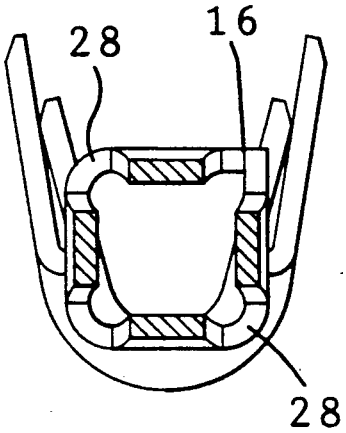
FIG. 13 is a view taken on the lines 13—13 of FIG. 9.
Figure 14:
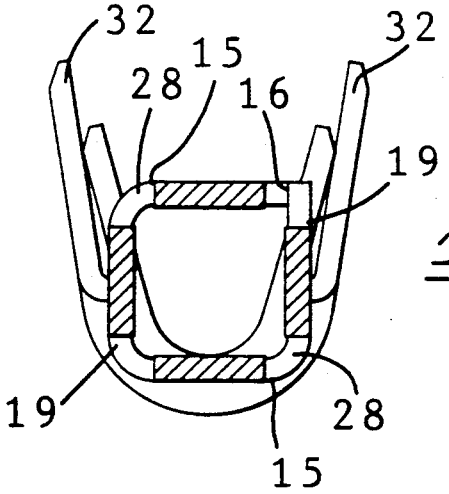
FIG. 14 is a view taken on the lines 14—14 of FIG. 2.

As shown in FIGS. 1, 4 and 5, a socket terminal 2 is provided with a protective metal sleeve 4.

Figure 2:
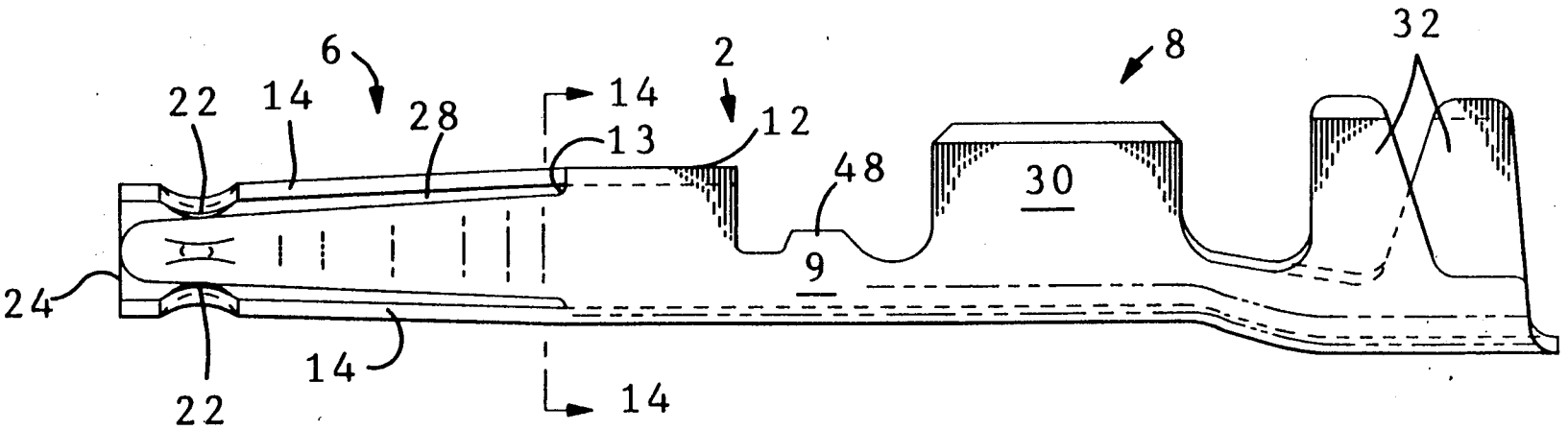
FIG. 2 is a side view of a socket terminal.
Figure 15:
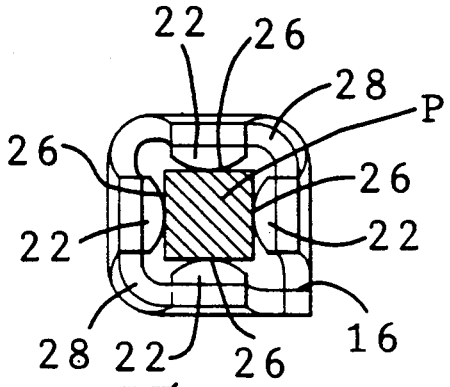
FIG. 15 is a front end view of the socket terminal showing, in cross section, an electrical pin mated with the socket terminal.

The socket terminal 2 comprises, as best seen in FIGS. 2 and 3, a stamped and formed metal socket 6 and a wire connecting portion 8 joined to the socket 6 by a transition portion 9, the terminal 2 having been formed from a sheet metal blank 10 which is shown in FIG. 15.

The socket 6 comprises a substantially square cross-section, tubular base 12 of constant cross-sectional area, from the forward end 13 of which extends a pair of elongate contact springs 14, formed from portions 14' of the blank 10. The base 12 is formed to its square cross-sectional shape from a portion 12' of the blank 10, and has a seam 16 defined by opposite edges 17' of said portion 12'. Each contact spring 14 extends from a respective pair of adjacent edges 15 and 19 (FIG. 14) at the forward end 13 of the base 12. As will be apparent from FIGS. 4 and 5, each contact spring is substantially L-shaped as seen in cross section, comprising two identical planar parts 18 and 20, so that the contact spring 14 are of substantially square overall cross section, as seen in FIGS. 5, 10, 12 to 14 and 15. Each contact spring 14 has formed in both of its parts 18 and 20, a contact boss 22 projecting inwardly of the socket at a position remote from the base 12 and proximate to the forward end 24 of the socket 6. Each boss 22 defines a smoothly arcuate, part-spherical contact surface 26, the surfaces 26 being arranged in precisely opposed pairs and being constantly spaced about the internal periphery of the socket 6, as best seen in FIGS. 5, 10, 12, 14 and 15. Between the contact bosses 22 and the base 12, each contact spring 14 is longitudinally divided by a slot 28, as will be apparent from a study of slots 28' in the blank 10. Thus, the parts 18 and 20 of each contact spring 14 are connected together, by a fold 21, at the contact bosses 22 and between the bosses 22 and the end 24, the parts 18 and 20 also being connected at the base 12. The contact springs 14 are substantially parallel to one another between the base 12 and the end 24 and are arranged in rotational symmetry.

Figure 16:
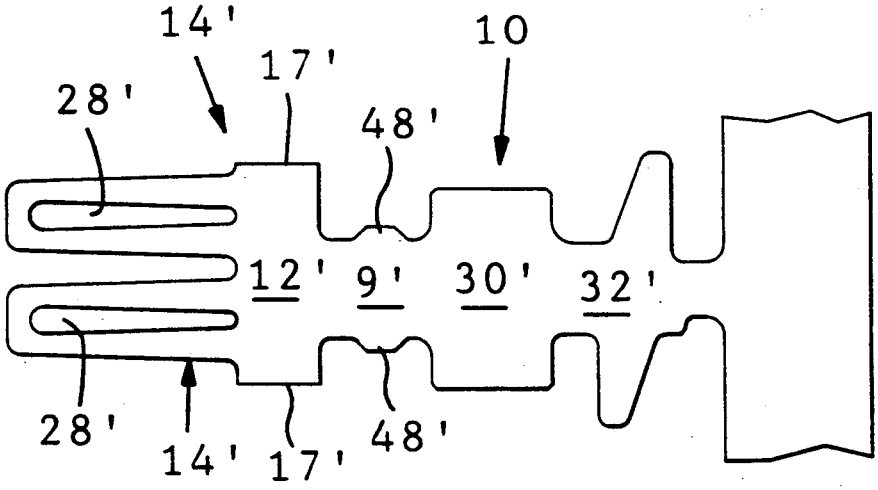
FIG. 16 is a plan view of a sheet metal blank from which the socket terminal was formed.

The wire connecting portion 8 comprises a substantially U cross section wire barrel 30 for crimping about the stripped electrically conductive core of an insulated electrical lead (not shown) and a pair of upstanding ears 32 for crimping about the insulation of the lead, the transition portion 9 also being of substantially U-shaped cross section. The portions of the blank pin from which the barrel 30 and ears 32, were formed, are referenced 30' and 32', respectively, in FIG. 16.

The protective sleeve 4 is, as best seen in FIGS. 4, 5 and 8, of substantially square cross section and was stamped and formed from a single piece of sheet metal, as was the socket terminal 2. The sleeve 4 has struck from its upper, as seen in FIGS. 4, 6 and 8, wall 36, a locking tongue 38 having a free end 39 for engaging a shoulder in a cavity in an insulating housing (not shown) for the purpose of retaining the socket terminal 2 therein. One side wall 40 of sleeve 4 project above the wall 36 to provide a keying plate 42 for reception in a groove in the housing, for the purpose of properly orienting the terminal 2 with respect thereto. The plate 42 extends slightly above the free end 39 and thus affords some protection for the locking tongue 38. The forward end 37 of the sleeve 4 has projecting therefrom, obliquely inwardly of the sleeve 4, four retaining flanges 44 and at its rear end 45, a pair of opposed clinching ears 46. The sleeve 4 is assembled to the socket terminal 2 by inserting the latter with its forward end 24 leading, through the rear end 45 of the sleeve 4 until the forward end 24 abuts the flanges 44, and then clinching the ears 46 about the transition portion 9 forwardly of a pair of upstanding projections 48 thereof. The sleeve 4 is thus fixedly attached to the terminal 2 since the ears 46 lie between the projections 48 and the base 12 of the terminal 2.

Figure 15A:
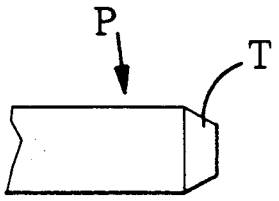
FIG. 15A is a fragmentary side view showing the leading end portion of the pin.

When a square cross section electrical pin P having a tapered leading end portion T as shown in FIG. 15A, is inserted through the forward end 24 of the terminal 2, each of the four sides of the pin P is engaged by a respective contact surface 26, as shown in FIG. 15, so that the parts 18 and 20 of each spring 14 are splayed slightly apart, flexing resiliently about the fold 21. By virtue of the slots 28, the connected parts 18 and 20 of the contact springs 14 can flex apart from one another without undue resistance, so that the insertion force of the pin P and the contact force exerted by the contact surfaces 26 against the pin P are held to an acceptable level.

The contact and insertion forces can easily and accurately be predetermined for given pin cross-sectional dimensions by appropriately selecting the dimensions of the slots 28' in the blank 10.

The contact force exerted by the surfaces 26 against the sides of the pin P should be made high enough to provide satisfactory electrical contact between the surfaces 26 and the sides of the pin P without the insertion force of the pin P being unduly high.

The flanges 44 of the sleeve 4 act to restrain overstress of the contact springs 14 should an oversized pin be inserted into the socket 6 or should a pin be inserted into the socket 6 in misalignment therewith.

Preferably, the base 12 is laser welded, at positions X indicated in broken lines 14 in FIG. 3, to provide a more stable support for the contact springs 14, the sleeve 4 also being preferably laser welded at positions Y indicated in broken lines in FIGS. 6 and 7, for improved protection of the contact springs 14 against overstressing.

What is claimed is:

1. An electrical socket terminal having an elongate stamped and formed metal socket comprising a tubular base having a forward end, and first and second elongate contact springs arranged in rotational symmetry and projecting forwardly from the base, each contact spring having a forward end and a rear end comprising two orthogonally arranged planar parts extending forwardly, each planar part being connected to the base at the rear end of said planar part and the planar parts being connected to their forward ends by a fold in the contact spring, which fold extends longitudinally of the socket and about which fold said planar parts of the contact spring are resiliently flexible by virtue of a slot separating said planar parts and extending from said fold towards the base, each planar part of each contact spring having projecting from the plane thereof a contact surface located rearwardly of, and adjacent to, the fold in the contact spring, each of the contact surfaces of the first contact spring facing a respective contact surface of the second contact spring, whereby said contact surfaces are engageable by an electrical pin introduced between the contact surfaces to cause the planar parts of each contact spring resiliently to flex angularly away from each other about the fold by which said planar parts of such contact spring are connected together.

2. A terminal as claimed in claim 1, wherein said planar parts of the first and second contact springs are of identical dimensions and the contact surfaces of the contact springs are uniformly spaced from each other, the tubular base being defined by two pairs of orthogonally arranged walls and the rear end of each said planar part being formed integrally with a forward end of a respective one of said walls of the base.

3. An electrical socket terminal having an elongate stamped and formed metal socket comprising a tubular base having a forward end, and first and second elongate cantilever contact springs projecting forwardly from the forward end of the base, each contact spring comprising two planar parts defining an angle between them, and a hinge extending longitudinally of the socket and connecting the forward ends of two planar parts of the contact spring for resilient angular movement about said hinge, the planar parts of each contact spring being separate from each other between the respective hinge and the base, each of the planar parts being connected to said forward end of the base, at the rearward end of said planar part, the planar parts being resiliently angularly displaceable by an electrical pin when introduced between the contact springs from their forward ends.

4. A terminal as claimed in claim 3, wherein said planar parts of each contact spring define an angle of 90° and are of identical dimensions, each planar part having a bowed contact surface, projecting from the plane of said planar part towards the bowed contact surface of an opposite one of said planar parts and being positioned adjacent to the hinge of said contact spring.

5. A terminal as claimed in claim 4, wherein all of the contact surfaces are located in the same plane and are equally distantly spaced from each other.

6. A terminal as claimed in claim 3, wherein a protective sleeve surrounding the socket has a flange aligned with the forward end of each contact spring for restraining the displacement of such forward end by said electrical pin.

7. A terminal as claimed in claim 3, wherein said contact springs define a substantially square section passage for receiving said electrical pin, each of said planar parts having projecting from the plane thereof a convex contact surface projecting into said passage.

8. A terminal as claimed in claim 7, wherein said contact surfaces project into said passages from respective sides thereof, the contact surfaces of each contact spring projecting towards respective contact surfaces of the other one of said contact springs.

9. A terminal as claimed in claim 3, wherein the contact springs are arranged in rotational symmetry, the planar parts of each contact spring being arranged orthogonally, and each planar part having a contact surface positioned adjacent to the hinge of the contact spring and centrally of the width of the planar part.

10. An electrical socket terminal, comprising an elongate stamped and formed metal socket having walls defining a rectangular cross section, tubular, rear base, each wall having a forward end, the socket further having a pair of elongate, cantilever, contact springs projecting forwardly from the base, each contact spring comprising two planar parts each having a forward and a rear end, the planar parts of each contact spring cooperating to define a right angle between them, a hinge extending longitudinally of the socket connecting the forward ends of the two planar parts of each contact spring for resilient angular movement of said planar parts towards and away from each other about said hinge, the planar parts of each contact spring being separated from each other by a slot extending between the respective hinge and the base, and the rear end of each of said planar parts being formed integrally with the forward end of a respective one of said walls of the base, the planar parts of each contact spring being resiliently displaceable away from each other by an electrical pin when introduced between said planar parts from their forward ends.

* * * * *